US007261184B2

(12) United States Patent
Bass et al.

(10) Patent No.: US 7,261,184 B2
(45) Date of Patent: Aug. 28, 2007

(54) ELEVATOR SYSTEM AND TRIANGULATED SUPPORT STRUCTURE FOR THE SAME

(75) Inventors: Patrick M. Bass, Lakeside, CA (US); John W. Koshak, Ramona, CA (US)

(73) Assignee: Thyssen Elevator Capital Corp., Whittier, CA (US)

( * ) Notice: Subject to any disclaimer, the term of this patent is extended or adjusted under 35 U.S.C. 154(b) by 295 days.

(21) Appl. No.: 10/353,173

(22) Filed: Jan. 28, 2003

(65) Prior Publication Data

US 2004/0154875 A1 Aug. 12, 2004

(51) Int. Cl.
*B66B 11/08* (2006.01)

(52) U.S. Cl. ..... 187/242; 187/256; 187/408; 187/266

(58) Field of Classification Search ..... 187/242, 187/240, 254, 256, 408, 406, 266, 411, 412; 248/200, 300, 316.8, 637, 678
See application file for complete search history.

(56) References Cited

U.S. PATENT DOCUMENTS

| | | | | |
|---|---|---|---|---|
| 4,231,148 A | | 11/1980 | Harding | 29/469 |
| 5,469,938 A | | 11/1995 | Biewald et al. | 187/408 |
| 5,490,577 A | * | 2/1996 | Yoo | 187/252 |
| 5,490,578 A | | 2/1996 | Aulanko | 187/254 |
| 5,833,031 A | | 11/1998 | Liebetrau | 187/239 |
| 5,899,300 A | * | 5/1999 | Miller et al. | 187/256 |
| 6,035,974 A | | 3/2000 | Richter et al. | 187/404 |
| 6,079,520 A | | 6/2000 | Black et al. | 187/239 |
| 6,308,802 B1 | * | 10/2001 | Briere | 187/243 |
| 6,626,266 B2 | * | 9/2003 | Hamaguchi | 187/266 |
| 6,739,433 B1 | * | 5/2004 | Baranda et al. | 187/411 |
| 7,000,736 B2 | * | 2/2006 | Rice et al. | 187/408 |

FOREIGN PATENT DOCUMENTS

| | | |
|---|---|---|
| JP | 2001-019316 A | 1/2001 |
| WO | WO-01/79105 A | 10/2001 |

OTHER PUBLICATIONS

International Preliminary Report, dated Jul. 5, 2004 for PCT Application No. PCT/US04/002097.
Written Opinion, dated Jul. 5, 2004 for PCT Application No. PCT/US04/002097.
International Preliminary Report on Patentability, dated Feb. 4, 2005 for PCT Application No. PCT/US04/002097.

* cited by examiner

*Primary Examiner*—Emmanuel Marcelo
*Assistant Examiner*—Evan Langdon
(74) *Attorney, Agent, or Firm*—Frost Brown Todd LLC

(57) ABSTRACT

The invention comprises a support structure for an elevator system comprising a pit channel module having a first leg and a second leg connected at a corner, a header module having three sides forming a triangle which is disposed in a horizontal plane above the pit channel module, and pairs of car guide rails and counterweight guide rails extending vertically from the pit channel module to the header module. Vertical forces generated within the system are transferred from the rails through the pit channel module and into a foundation so that at least substantially no vertical load forces are imparted on the building structure which the system serves.

8 Claims, 4 Drawing Sheets

130
133
132
131
130C
130B
130A
140
170
160
A
A
110A
110B
B
B
140
170
160
111A
111B
150A
150B
140
170
160
121A
120A
121B
120
121C
C
C
120B 110A
111A 150B
151B 150A
170
110B
117
111B

ELEVATOR SYSTEM AND TRIANGULATED SUPPORT STRUCTURE FOR THE SAME

FIELD OF THE INVENTION

The invention relates to the field of elevators and lifting systems.

BACKGROUND

Traction elevator systems typically require that the suspended mass (the elevator car and counterweight) is supported from above. Traditional traction elevator systems used the building structure that the elevator served to support the suspended mass of the elevator system from above. This requires the building structure to have sufficient strength to support a large mass and to withstand large reaction forces. Many buildings do not meet this requirement because of age or design.

Thus, there is a need for a self-supporting elevator system which is comprised of light weight modular components, yet which is inherently stable and resistant to oscillations, and does not impart any substantial load forces on the structure of the building which the elevator serves.

SUMMARY OF THE INVENTION

The invention concerns a traction elevator system having a triangulated rail support structure for mounting within a hoistway, or other enclosure, and minimizing the vertical load on the building structure which the elevator serves. The invention also concerns the underlying triangulated support structure for mounting such elevator systems within a hoistway or other enclosure.

The system comprises a pit channel module having a first leg and a second leg connected at a corner. The pit channel module is oriented so the legs are in a plane and it is then mounted horizontally and leveled on the foundation floor of the hoistway. A header module having three sides forming a triangle is disposed in a horizontal plane above the pit channel module. The header module includes a first side, a second side, and a third side. The first and second sides of the header correspond in length and position to the first and second legs of the pit channel module, respectively. That is, the first side of the header module is substantially the same length as the first leg of the pit channel module, and is located vertically above the first leg. Similarly, the second side of the header module is substantially the same length as the second leg of the pit channel module, and is located vertically above the second leg of the pit channel module.

A pair of car guide rails extends vertically from the first leg of the pit channel module to the first side of the header module. A pair of counterweight guide rails extends vertically from the second leg of the pit channel module to the second side of the header module. The lower ends of both rail pairs are connected to the pit channel module and the upper ends are connected to the header module. The rails transfer forces within the system through to the pit channel module and the foundation of the hoistway, thereby minimizing load forces transferred to the building structure. Each car guide rail and counterweight guide rail may be one long unit or composed of a plurality of sub-units that allow the system to be constructed in a modular fashion.

An elevator car assembly is mounted to slide along the car guide rails and has a front portion with guide shoes slidably coupled to the car guide rails. Similarly, a counterweight assembly is mounted to slide along the counterweight guide rails and has guide shoes slidably coupled to the counterweight guide rails.

The header module has one or more suspension sheaves within the area defined by the three sides of the header. A rope passes over the sheave(s) and supports the elevator car and counterweight assemblies. The rope is in turn driven by a motor which displaces the rope and consequently moves the elevator car and the counterweight assemblies.

In one embodiment of the invention the legs of the pit channel module intersect one another at a right angle. In this embodiment the header module may similarly be configured so that two of its sides intersect at a right angle. In a related embodiment, the pit channel module is L-shaped so that the first leg is longer than the second leg. In this embodiment, the header module can correspondingly be in the shape of a right triangle with the first side longer than the second side.

The system can also include one or more coupling brackets, car guide rail brackets, and counterweight guide rail brackets. Each coupling bracket is connected to one of the car guide rails and to one of the counterweight guide rails. Each car guide rail bracket is connected to the car guide rails. The car guide rail bracket may optionally then be fixed to a point in the hoistway structure. Each counterweight guide rail bracket is connected to the counterweight guide rails. The counterweight guide rail bracket may optionally then be fixed to a point in the hoistway structure. The coupling bracket, car guide rail bracket and counterweight guide rail bracket may be formed into one unit or may be separate pieces. In a one embodiment, the brackets are collectively displaced incrementally along the height of the system (for example, every ten feet) so that the system may be installed in a modular fashion.

In another embodiment of the invention, one sheave in the area defined by the three sides of the header module is located over the center of mass of the elevator car assembly and this sheave is used to suspend the elevator car assembly. The placement of the sheave in this location ensures that the elevator car assembly will travel smoothly along the elevator car guide rails with minimal lateral protuberances.

In typical practice, the foundation on which the pit channel module is placed during installation is usually uneven and contains gaps. When the pit channel module is installed on the foundation, it is very important for the pit channel module to be level. With the pit channel module level, the rails, when installed will be oriented vertically and the header module will be located directly above the pit channel module. This orientation ensures that at least substantially all of the forces on the structure are transferred by the rails through the pit channel module to the foundation and substantially no forces are transferred to the structure of the building which the elevator system serves. Accordingly, for an uneven and/or unlevel foundation, the pit channel module can be placed in a level orientation above the foundation and an unhardened cementitious material can be introduced in-between and around the pit channel module to fill any gaps or uneven areas between the pit channel module and the foundation. The unhardened structural material is then allowed to harden. The pit channel module is thus secured, with or without the use of fasteners, in this level position and the remaining components will be oriented correctly. The pit channel module may also optionally have holes for receiving and interlocking the pit channel module with the cementitious material.

The distance between the car guide rails may be substantially equal to the length of the first leg of the pit channel module and the first side of the header module, i.e., the two car guide rails can be disposed near or at the opposite ends of the first leg of the pit channel module. The distance between the counterweight guide rails can, for example, be positioned at or near the ends of the second leg of the pit channel module and the second side of the header module. In particular, one counterweight guide rail can be attached to the pit channel module at the end of the second leg and is attached to the header module at the corner between the second and third side. The other counterweight guide rail is attached to the pit channel module at a point on the second leg adjacent to the corner and is attached to the header module at a point along the second side adjacent to the corner between the first and second sides.

The machine may be fixed to the pit channel module. The machine may comprise a motor output drive containing a drive sheave for frictionally engaging the rope. The drive sheave thereby moves the rope, which in turn displaces the elevator car and counterweight.

The elevator car assembly can be of a car sling type. The car sling has two vertically oriented stiles having upper and lower ends and front and back sides. A horizontal footer beam connects the lower ends of the stiles. A horizontal bolster beam connects the upper ends of the stiles and is attached to the back side of the stiles. A horizontal header beam connects the stiles below the upper ends and attached to the front side of the stiles. A cross-beam oriented normally to the header and bolster beams passes above the header beam and below the bolster beam to a pick-up point, which can be located above the center of mass of the elevator car assembly. The elevator car is disposed within the area defined by the stiles, the footer beam and the header, and is lifted from the pick-up point. The pick-up point may comprise a sheave for engaging the rope.

DETAILED DESCRIPTION

Figures 1, 1A, 1B:
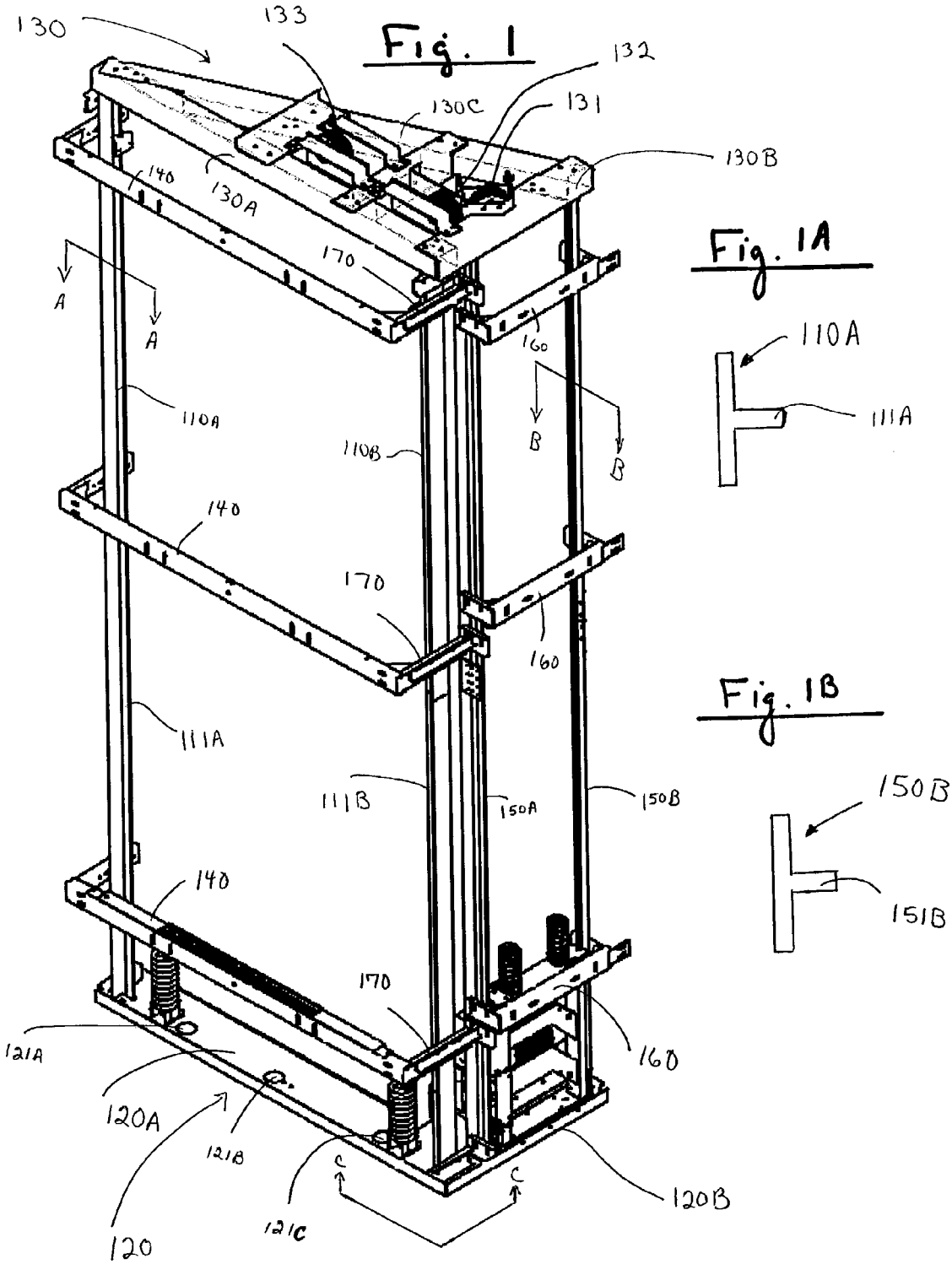
FIG. 1 is an isometric view of the triangulated rail support way structure of the invention.
FIG. 1A is a top view of car guide rail 11A taken along lines A—A of FIG. 1.
FIG. 1B is a top view of counterweight guide rail 150B taken along lines B—B of FIG. 1.

FIG. 1 shows an embodiment of the triangulated rail support structure according to the invention. The embodiment comprises a pair of vertically-oriented elevator car guide rails, 110A and 10B. Each car guide rail may be one-piece or, alternatively, each car guide rail may be composed of subunit segments attached end-to-end to one other. Each of the car guide rails is attached, at its base, to pit channel module 120 having two legs 120A and 120B, being L-shaped. Holes 121A–121C are formed in the pit channel module 120 to facilitate the fixation of the pit channel module 120 within a hardening structural material, for example, a cementitious material such as concrete or a synthetic epoxy "concrete," such as Cementall™. In particular, when installing the pit channel module 120 within the pit, the installer may set the pit channel module on the floor of the pit, pour the cementitious material in and around the holes 121A, B and C, adjust the pit channel module 120 so it sits level on the floor, and then allow the cementitious material to harden. The floor of the pit is usually uneven and full of cracks and holes. The cementitious material fills in the uneven areas in the floor to ensure that the pit channel module 120 remains level and secures the position of the module.

Each of the car guide rails 110A and 110B is also attached, at its top end, to a triangulated header module 130. The header module is triangular and composed of three sides 130A, B and C. The header module may, for example, comprise three attached segments forming the triangular structure of the header module or comprise a one-piece triangular structure. The header module 130 is disposed above the pit channel module 120 and sides 130A and 130B of the header module correspond in length and location to the legs 120A and 120B of the pit channel module. In the embodiment shown, the face of each car guide rail 110A and 110B which faces the other guide rail has a protruding "tongue," 111A and 111B, that extends vertically along the guide rail. FIG. 1A illustrates a cross section of car guide rail 110A with tongue 11A. The tongues are designed to interface with at least one shoe 117 attached on each side of an elevator car (See FIG. 1C) riding in the supportway so that the horizontal motion of the elevator in the supportway is restrained, while up and down movement of the car along the rails is provided.

The embodiment further comprises two vertically-oriented counterweight guide rails, 150A and 150B. The counterweight guide rails may also be one-piece or composed of attached subunit segments. Each of the counterweight guide rails, 150A and 150B, is attached to the triangulated pit channel module 120 at one end and to the triangulated header module 130 at the opposite end. Like the car guide rails, each of the counterweight guide rails, 150A and 150B, may have a protruding tongue on the face of the rail which faces the other counterweight guide rail in order to interface with at least one cooperating shoe disposed on each side of a counterweight frame, thereby guiding the travel of the counterweight carriage. FIG. 1B shows a cross-section of outside counterweight guide rail 150B with a protruding tongue 151B.

A number of brackets serve to brace the configuration of the elevator supportway of the embodiment. A horizontally-oriented car guide rail bracket 140 is attached to car guide rails 110A and 110B, at successive intervals. For example, car guide brackets 140 may be spaced at approximately 10-foot intervals, i.e., at the typical intervals between the floors of a building. Since, in this embodiment, the horizontally spanning portion of the car guide rail brackets 140 will face the car-door-opening side of the supportway, these brackets are vertically spaced to allow passengers and/or cargo to exit the elevator car onto a building floor or platform without obstruction. The horizontally-spanning portion of the car-guide-rail brackets 140 of the supportway structure of the invention may also be directly or indirectly fastened or attached to the building structure which the elevator serves. Such attachment does not transmit any substantial vertical loads to the building structure, but merely serves to keep the elevator supportway structure and the building structure in close approximation, but nevertheless separated from each other in the respect to horizontal plane.

Figure 1C:
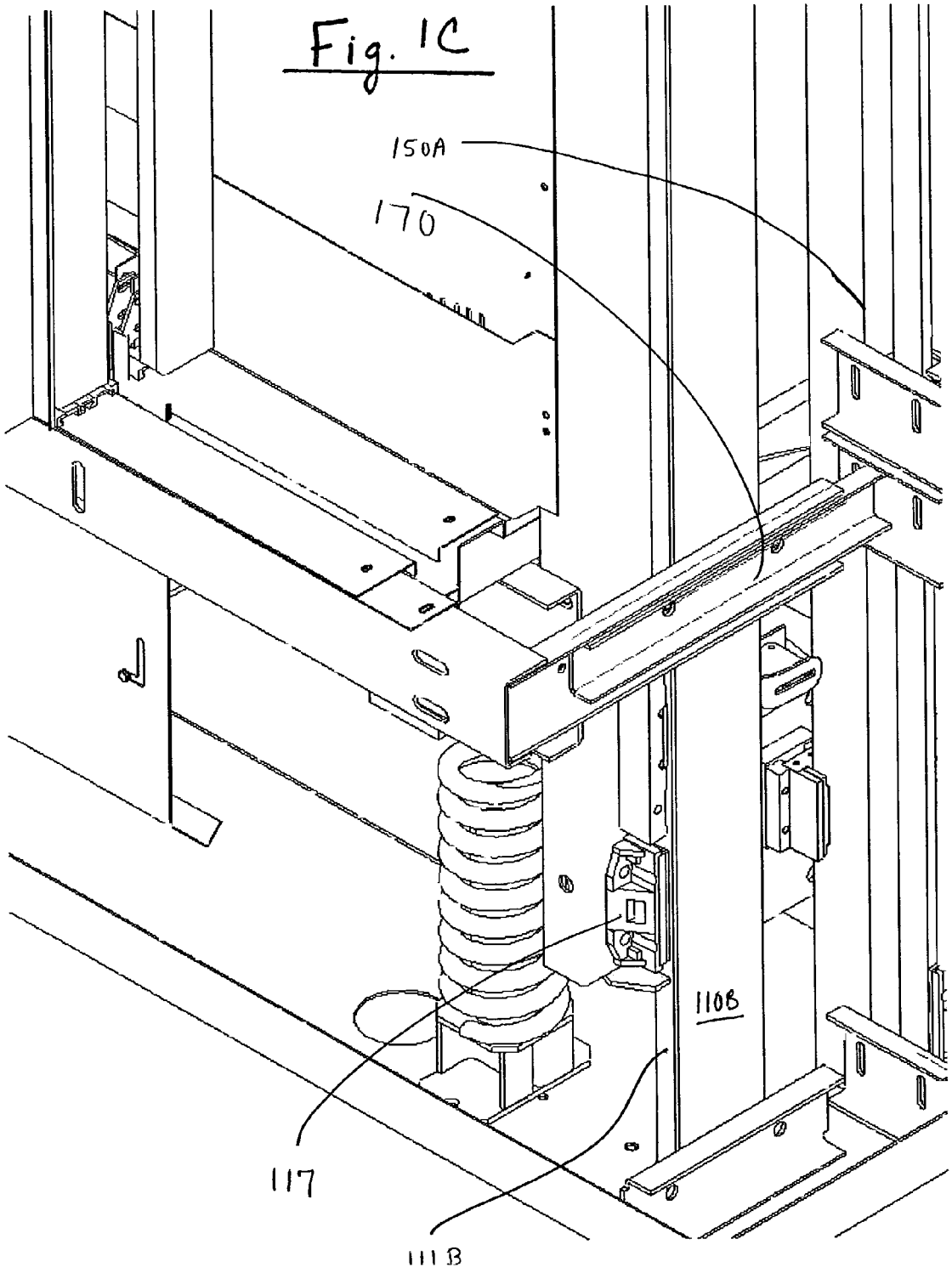
FIG. 1C is an enlarged view of a portion of the triangulated rail support structure taken along lines C—C of FIG. 1.

Referring to FIGS. 1A and 1C, brackets 170 are horizontally-oriented brackets attaching the inner car guide rail 110B and the inner counterweight guide-rail 150A, at successive intervals. As shown, bracket 170 may also be attached to car guide rail bracket 140. Referring to FIG. 1A, a horizontally-oriented counterweight rail bracket 160 is attached to each of the counterweight guide rails 150A and 150B, at successive intervals. As shown in FIG. 1, the three types of brackets occur together at approximately the same vertical intervals along the elevator supportway. Alternate configurations and spacings are also possible and within the scope of the invention. For example, a single bracket member configured to take the place of any two or all three of the described types of brackets can be used.

Figure 2:
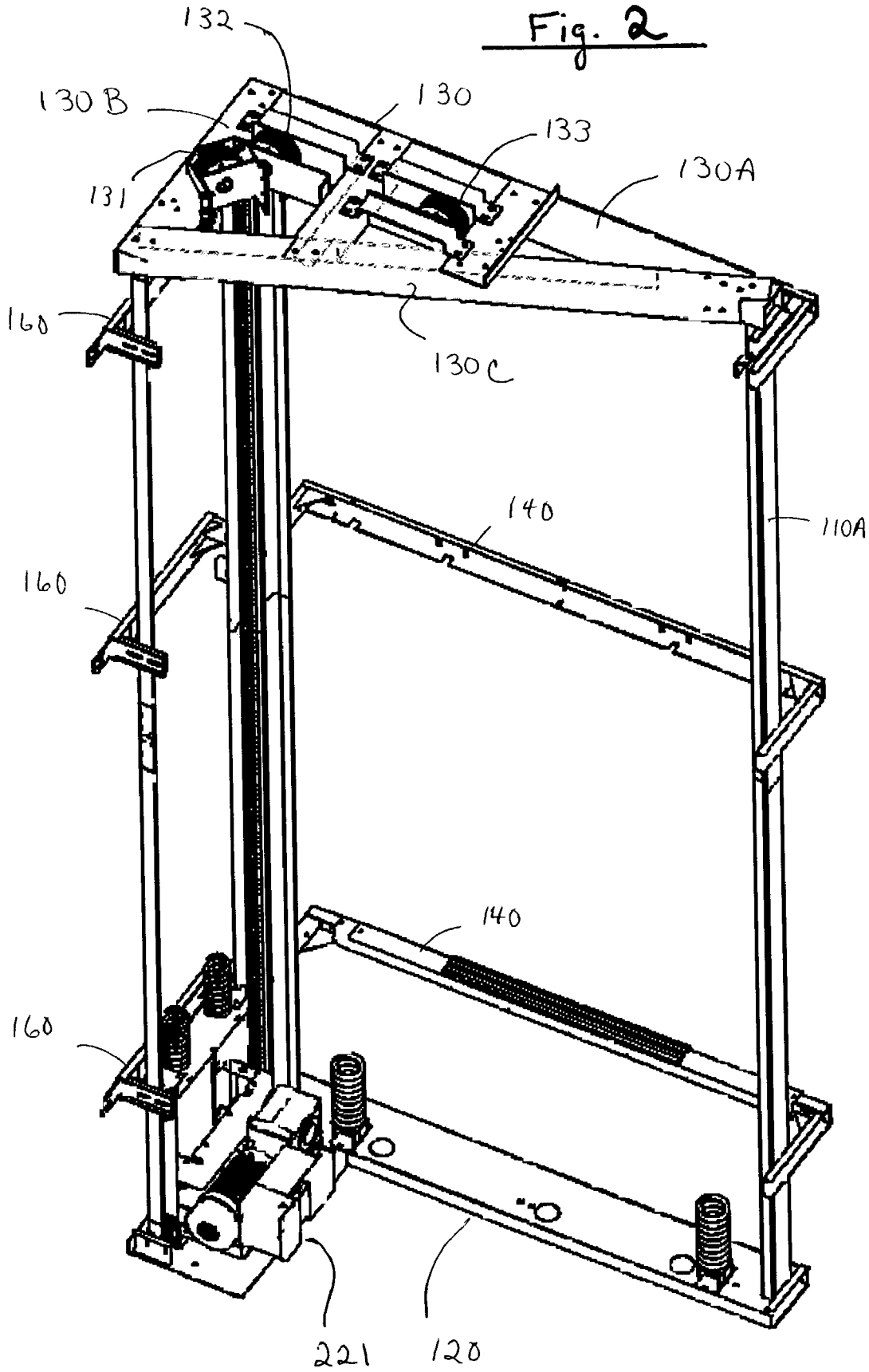
FIG. 2 is an isometric view of the structure shown in FIG. 1 from the opposite side.

As further shown in FIGS. 1 and 2, within the perimeter of the triangular header module 130, the header module further comprises three deflector sheave assemblies, 131–133, each comprising a sheave mount and a sheave. As shown, the sheave assemblies are configured for an elevator roping set-up in conjunction with an elevator car and a counterweight (see FIG. 3). Sheave 133 is disposed so that a support rope engaged therewith can support an elevator car, riding in the supportway structure, from above the center of gravity of the car or an average—calculated center of gravity of the car assembly.

FIG. 2 shows the embodiment of FIG. 1 from the opposite side. An elevator drive machine 221 is connected to the pit channel module 120. The drive machine 221 may be of any suitable sort for operating rope/cable supported elevator systems.

Figure 3:
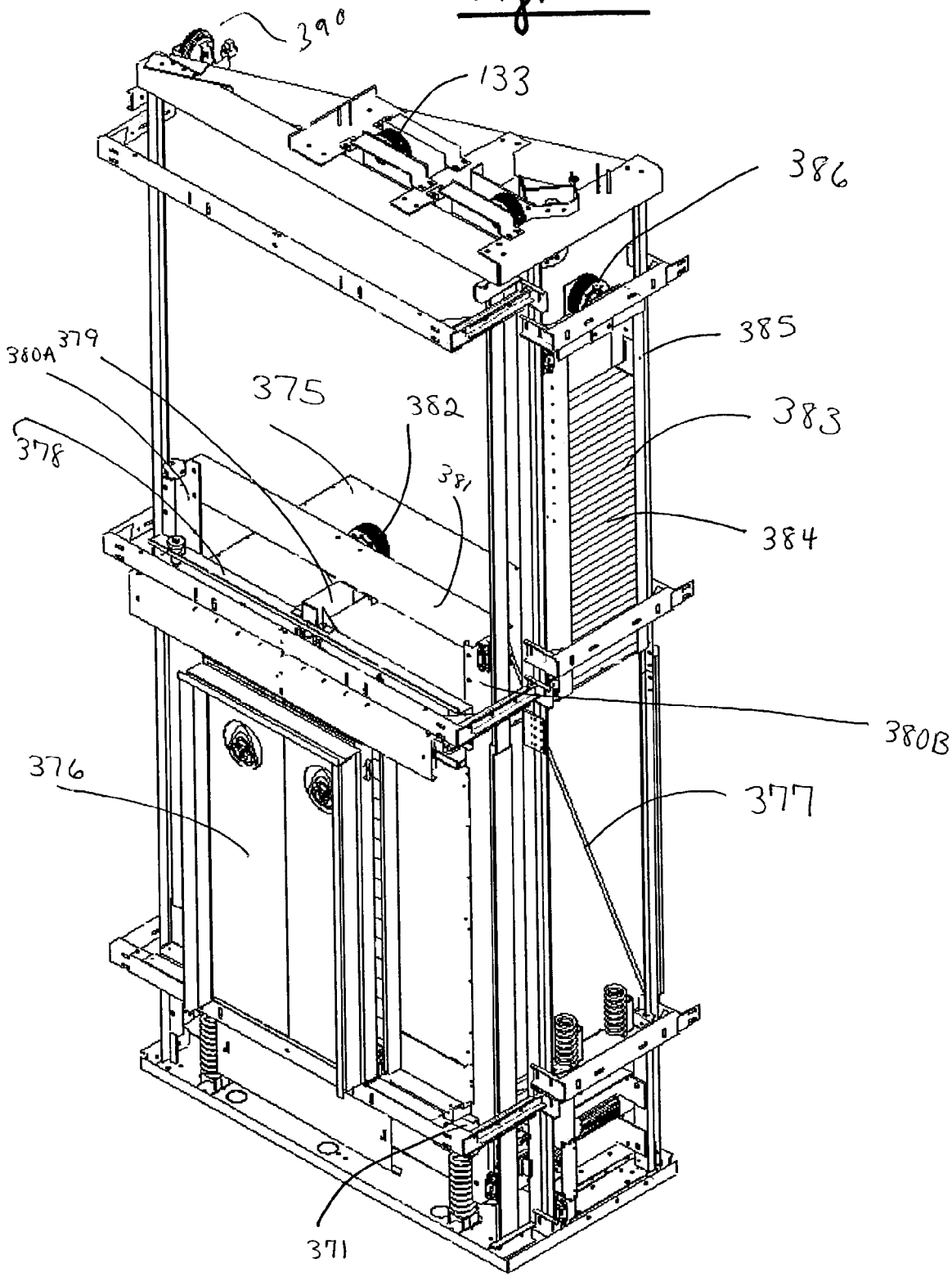
FIG. 3 is an isometric view of the traction elevator system having a triangulated rail support structure according to the invention.

FIG. 3 shows an embodiment of an elevator system comprising an elevator supportway structure (as shown in FIGS. 1 and 2), an elevator car 375 and a counterweight assembly 383, according to the invention. The elevator car of the embodiment has an elevator car door 376. A diagonal support brace 377 connecting the top and bottom of the elevator car is disposed on each of the two sides of the elevator car adjacent to the door side.

The elevator car of the embodiment comprises a sling and is supported from its top via a pick sheave 382 which is supported by a pick sheave support assembly. Two stiles 380A and B extend along the vertical length of the door-side of the elevator car and protrude above the roof of the elevator car. A header beam 378 is attached to the top of the elevator car near the door side and to the front side of the two vertically oriented stiles 380A and B. A horizontal footer beam 371 is attached to the elevator car and to each of the stiles near the base of the elevator car. At about the center-point of the door side of the car, a sheave support beam 379 is attached to the header beam 378. The sheave 382 is attached to the sheave support beam 379. A bolster beam is attached on the back side of the stiles 380A and B above the sheave beam 379. In this manner the sheave beam cross vertically over header beam 378 and under bolster beam 379. The configuration of header beam 378, sheave support beam 379 and bolster beam 381 provide the appropriate structural support so that the car may be supported by the rope riding around pick sheave 382.

A counterweight assembly 383 is also provided to run between the counterweight guide rails. The counterweight assembly of the embodiment comprises a counterweight frame 385, weight bars 384 stacked in the frame and a counterweight pick sheave 386 attached to the top of the counterweight frame so that the counterweight assembly can be supported from a support rope.

The system may also include a governor 390 attached to the header module 130. The governor 390 is for safety purposes as commonly known in the art.

FIG. 3 shows a sheave configuration for a 2 to 1 roping arrangement. Those skilled in the art will recognize that elevator systems according to the invention may be configured for roping in numerous manners. As shown, sheave 133 of the header module 130 is disposed above pick sheave 382 of the elevator car so that the elevator car is supported by the rope from above its center of gravity or from above an average center of gravity for the elevator car plus a specified number of passengers, for example two passengers.

The invention provides a modular, self-supporting elevator system support structure having an at least substantially triangular configuration transverse to its vertical axis. Such a triangularly-configured support structure is structurally stable, resists deformation and oscillations, and, while being composed of relatively light weight components and being relatively light-weight overall, nevertheless allows at least substantially all of weight of the operating elevator system to be self supported at the base of the structure.

Accordingly, another embodiment of the invention provides an elevator system comprising: (i) an elevator system support structure comprising: a pit channel module; a header module located above the pit channel module; and a plurality of load-bearing guide rails, one end of each guide rail being attached to the pit channel module and the opposite end of each guide rail being attached to the header module, the longitudinal axes of the rails being parallel to one another, the guide rails disposed to collectively define a triangle in the plane transverse to the vertical axes of the guide rails; (ii) an elevator car assembly being at least partially disposed within the area of the triangle defined by the guide rails, the elevator being vertically displaceable between the header module and pit channel module; and (iii) a rope for supporting the elevator car from the header module, wherein at least substantially all of the vertical load forces on the system are carried by the load-bearing guide rails to the pit channel module.

In a related embodiment of the invention, the load-bearing guide rails comprise elevator car guide rails and elevator counterweight guide rails, and the elevator car is slidably coupled to the car guide rails. In a further related embodiment of the invention, the elevator car assembly protrudes transversely beyond one side of the triangle defined by the elevator car guide rails. In another related embodiment, the elevator system further comprises a counterweight assembly slidably coupled to the counterweight guide rails.

In a still further related embodiment of the invention, the elevator system comprises one or more suspension sheaves within the header module, the suspension sheaves supporting the rope. In another related embodiment, the point of support of the elevator car with respect to the transverse plane is disposed with the area of the triangle defined by the guide rails. In a further related embodiment, the elevator car assembly is supported from above its center of gravity or a calculated average center of gravity.

In one embodiment of the invention, the pit channel module comprises a set of connection structures for connecting to the car guide rails and a set of connection structures for connecting to the counterweight guide rails, and the header module comprises a corresponding set of car guide rail and counterweight guide rail connecting structures, so that the car guide rails and the counterweight guide rails can be mounted vertically between the pit channel module and the header module. These connecting structures may be of any sort including bolts, bolt holes, recesses, protrusions, so long as the connecting structures are capable of connecting the car guide rail or counterweight guide rail to the module, with or without additional fasteners.

The rope, or cable, of an elevator system according to the invention may be of any suitable kind including, but not limited, to metal cable ropes as known in the art and ropes composed of synthetic materials, such as aramid fiber ropes, for example, nylon-jacketed aramid fiber ropes. In addition, the rope may comprise suspension members of different kinds and shapes, for example, chains and flat belts.

The examples and embodiments described herein are understood to be illustrative of the invention and not limiting of its scope. Many modifications and variations of the invention which are within its scope may be apparent to those skilled in the art. Accordingly, the scope of the invention is to be determined in connection with the appended claims and their equivalents.

We claim:

1. A traction elevator system having a triangulated rail support structure, the system comprising:

a pit channel module having a first leg and a second leg connected at a corner, the pit channel module for being mounted horizontally and leveled on the foundation floor of the hoistway;

a header module forming a triangle disposed in a horizontal plane above the pit channel module, and comprising a first side, a second side, and a third side, the first and second sides of the header corresponding in length and position to the first and second legs of the pit channel module, respectively, and wherein the pit channel module is L-shaped with the first leg longer than the second leg, and the header module is in the shape of a right triangle with the first side longer than the second side and wherein the pit channel module has holes for receiving a hardening structural material;

a pair of car guide rails vertically extending from the first leg of the pit channel module to the first side of the header module, wherein said car guide rails are attached to the pit channel module at or near the ends of the first leg of the pit channel module;

a pair of counterweight guide rails vertically extending from the second leg of the pit channel module to the second side of the header module wherein the counterweight guide rails are attached to the pit channel module at or near the ends of the second leg of the pit channel module and wherein (a) one counterweight guide rail is attached to the pit channel module at the end of the second leg and is attached to the header module at the corner between the second and third side, and (b) the other counterweight guide rail is attached to the pit channel module at a point on the second leg adjacent to the corner and is attached to the header module at a point along the second side adjacent to the corner between the first and second sides;

an elevator car assembly having a front portion with guide shoes slidably coupled to the car guide rails, the car assembly slidable along the car rails, said car assembly further comprising a car sling comprising:

two vertically oriented stiles having upper and lower ends and front and back sides, a horizontal footer beam connecting the lower ends of the stiles;

a horizontal bolster beam connecting the upper ends of the stiles and attached to the back side of the stiles;

a horizontal header beam connecting the stiles below the upper ends and attached to the front side of the stiles; and a sheave beam passing above the header beam and below the bolster beam to a pick-up point, wherein the elevator car is supported by the sling within the area defined by the stiles, the footer beam and the header and the elevator is lifted from the pick-up point;

a counterweight assembly having guide shoes slidably coupled to the counterweight guide rails, the counterweight assembly slidable along the counterweight guide rails;

one or more suspension sheaves within the area defined by the three sides of the header module, wherein one sheave in the area defined by the three sides of the header module is located over the center of mass of the elevator car assembly;

a coupling bracket connected to one of the car guide rails and to one of the counterweight guide rails;

a car guide rail bracket connected to the car guide rails, the car guide rail bracket for being fixed to a point in the hoistway;

a counterweight guide rail bracket connected to the counterweight guide rails, the counterweight guide rail bracket for being fixed to a point in the hoistway;

a rope passing over the sheave(s) and supporting the elevator car and counterweight assemblies; and a motor for driving the rope to move the elevator car and the counterweight assemblies, said motor being fixed to the pit channel module.

2. The fraction elevator system of claim 1, wherein the pick-up point further comprises a sheave for engaging the rope.

3. The fraction elevator system of claim 2, further comprising a plurality of support braces extending from the bolster beam to the floor of the elevator car.

4. The fraction elevator system of claim 3, wherein the car guide rails comprise a plurality of subunit rails connected to one another.

5. The fraction elevator system of claim 4, wherein the counterweight guide rails comprise a plurality of subunit rails connected to one another.

6. The fraction elevator system of claim 5, wherein the rope comprises a synthetic material.

7. The fraction elevator system of claim 6, wherein the rope comprises an aramid material.

8. The fraction elevator system of claim 7, wherein the rope is covered with a nylon material.

* * * * *

UNITED STATES PATENT AND TRADEMARK OFFICE

CERTIFICATE OF CORRECTION

PATENT NO. : 7,261,184 B2
APPLICATION NO. : 10/353173
DATED : August 28, 2007
INVENTOR(S) : Bass et al.

It is certified that error appears in the above-identified patent and that said Letters Patent is hereby corrected as shown below:

Column 8, Claim 2, line 34, “The fraction”, please delete and replace with, --The traction--.

Column 8, Claim 3, line 37, “The fraction”, please delete and replace with, --The traction--.

Column 8, Claim 4, line 40, “The fraction”, please delete and replace with, --The traction--.

Column 8, Claim 5, line 43, “The fraction”, please delete and replace with, --The traction--.

Column 8, Claim 6, line 46, “The fraction”, please delete and replace with, --The traction--.

Column 8, Claim 7, line 48, “The fraction”, please delete and replace with, --The traction--.

Column 8, Claim 8, line 50, “The fraction”, please delete and replace with, --The traction--.

Signed and Sealed this

Eleventh Day of December, 2007

JON W. DUDAS
*Director of the United States Patent and Trademark Office*